United States Patent [19]

Yamashita

[11] Patent Number: 5,058,821

[45] Date of Patent: Oct. 22, 1991

[54] COIL BOBBIN

[75] Inventor: Takehiko Yamashita, Chiryu, Japan

[73] Assignee: Daiwa Electricity Plant Co., Ltd., Chiryu, Japan

[21] Appl. No.: 630,493

[22] Filed: Dec. 20, 1990

[30] Foreign Application Priority Data

Dec. 29, 1989 [JP] Japan ..... 1-341880

[51] Int. Cl.[5] ..... B65H 75/08; B65H 75/28; H01F 15/10

[52] U.S. Cl. ..... 242/118.4; 242/118.41; 242/125.1; 336/192; 336/208

[58] Field of Search ..... 242/118.4, 118.41, 118.7, 242/118.8, 118, 125, 125.1, 125.2; 336/185, 192, 199, 208

[56] References Cited

U.S. PATENT DOCUMENTS

| | | | |
|---|---|---|---|
| 1,704,151 | 3/1929 | Simpson | 242/118.4 X |
| 2,229,413 | 1/1941 | Joost | 336/192 |
| 3,259,864 | 7/1966 | Marzolf et al. | 336/192 |
| 3,315,198 | 4/1967 | Biesma et al. | 336/192 |
| 3,363,210 | 1/1968 | Hollyday | 242/118.4 X |
| 3,470,511 | 9/1969 | Heinzen | 336/192 X |
| 4,122,425 | 10/1978 | Hughes | 336/192 |
| 4,403,753 | 9/1983 | Gibas et al. | 242/125.2 |
| 4,546,340 | 10/1985 | Kuchuris | 336/208 X |

*Primary Examiner*—Stanley N. Gilreath

*Attorney, Agent, or Firm*—Oblon, Spivak, McClelland, Maier & Neustadt

[57] ABSTRACT

A coil bobbin includes a main cylinder portion opened at both ends around which a coil is wound, and a leader cable accommodating groove portion disposed in a manner surrounding the main cylinder portion at one end of the main cylinder portion on an outer peripheral surface of the main cylinder portion. The leader cable accommodating groove portion includes a leader cable front end accommodating portion for accommodating a front end of a leader cable, and the leader cable front end accommodating portion has a radialwise width, being smaller than a radialwise width of an inner portion of the leader cable accommodating groove portion, at a portion adjacent to an opening of the leader cable accommodating groove portion. Hence, the coil bobbin not only holds the leader cable in the leader cable accommodating groove portion stably, but also inhibits the leader cable from coming off the leader cable accommodating groove portion outward in an axial direction with the leader cable front end accommodating portion.

5 Claims, 11 Drawing Sheets

COIL BOBBIN

BACKGROUND OF THE INVENTION

1. Field of the Invention

The present invention relates to a coil bobbin, and more particularly to an improvement on a configuration of a leader cable accommodating groove portion of a coil bobbin.

2. Description of the Prior Art

An example of a conventional coil bobbin is illustrated in FIGS. 13, 14 and 15. The coil bobbin of this type comprises a main cylinder portion 1 opened at both ends thereof and made of a thin-walled resin around which a coil is wound, and a leader cable accommodating groove portion 2 for accommodating a leader cable. The leader cable accommodating groove portion 2 is made of a thin-walled resin, and disposed in a manner surrounding the main cylinder portion 1 at one end of the main cylinder portion 1 on an outer peripheral surface of the main cylinder portion 1. An outer peripheral configuration of the main cylinder portion 1 can be formed in various shapes, for instance, in a square cylinder, a simple cylinder or the like. The leader cable accommodating groove portion 2 has a shape which agrees with an outer periphery of the main cylinder portion 1.

An example of the conventional leader cable accommodating groove portion 2 is illustrated in FIGS. 13, 14 and 15. This leader cable accommodating groove portion 2 includes a bottom plate portion 21 disposed at one end of the main cylinder portion 1 in manner projecting from an entire periphery of the main cylinder portion 1 outward in a radial direction, a side wall portion 22 extending from a front end of the bottom plate portion 21, disposed away from the main cylinder portion 1 by a predetermined distance and extending in an axial direction, and a groove opening 23 opened in an axial direction.

At predetermined positions of the side wall portion 22, take-out cut-offs "d1" and "d2" are disposed in order to take out coiled cables "L1" and "L2." Further, as illustrated in FIG. 15, at another position of the side wall portion 22, a take-in cut-off "d4" is disposed in order to take leader cables "L3" and "L4" in. Furthermore, at the position of the take-in cut-off "d4," a leader cable holding plate portion 3 is disposed in a manner projecting from an outer periphery of the bottom plate portion 21 outward in a radial direction. Moreover, as illustrated in FIGS. 13 and 14, on both sides of the leader cable holding plate portion 3, presser covers 31 and 32 of a letter "L" shape substantially are disposed, thereby pressing and holding leader cables "L3" and "L4." As also illustrated in FIG. 14, the leader cables "L3" and "L4" are thus accommodated in the leader cable accommodating groove portion 2.

The leader cables "L3" and "L4" are inserted into the leader cable accommodating groove portion 2 as follows. First, the leader cables "L3" and "L4" are inserted into the leader cable holding plate portion 3. Thereafter, the leader cables "L3" and "L4" are pressed in an axial direction into the leader cable accommodating groove portion 2 by way of the groove opening 23 (See FIG. 15.).

Another example of the conventional leader cable accommodating groove portion 2 is illustrated in FIGS. 16, 17 and 18. This leader cable accommodating groove portion 2 includes a side wall portion 22, which is formed by cutting off the side wall portion 22 of the above-described conventional leader cable accommodating groove portion 2 by a semicircle on a side of the leader cable holding plate portion 3, and retainer plates 4 of a triangular shape substantially. The retainer plates 4 are disposed at two (2) predetermined positions on an outer periphery of the main cylinder portion 1, and they are provided in order to compensate the cut-off side wall portion 22. The leader cables "L3" and "L4" has been thus inhibited from coming off the leader cable accommodating groove portion 2 outward in an axial direction.

The leader cables "L3" and "L4" are inserted into the leader cable accommodating groove portion 2 as follows. First, the leader cables "L3" and "L4" are inserted into the leader cable holding plate portion 3. Thereafter, the leader cables "L3" and "L4" are bent inward in a radial direction, and then inserted into a space (See FIG. 18.) between the retainer plates 4 and the bottom plate portion 21. Finally, the leader cables "L3" and "L4" are pressed in an axial direction into the leader cable accommodating groove portion 2 by way of the groove opening 23.

It is apparent from the above-described two (2) examples of the conventional coil bobbin that the important thing in the manufacture of the coil bobbin is how to hold the leader cables "L3" and "L4" connected to the coiled cables "L1" and "L2" stably in the leader cable accommodating groove portion 2. When the leader cables "L3" and "L4" are displaced by external force, shock, vibration or the like, the leader cables "L3" and "L4" come off the leader cable accommodating groove portion 2, or the coiled cables "L1" and "L2" connected to the leader cables "L3" and "L4" break up. Here, there are two (2) vibrations, i.e., a vibration due to external cause and a self-vibration due to self-generating electromagnetic force.

For instance, in the case of the conventional leader cable accommodating groove portion 2 illustrated in FIG. 13, the leader cables "l3" and "L4" are stably held at an inlet portion of the leader cable accommodating groove portion 2 and they are inhibited from moving in a radial direction by the leader cable accommodating groove portion 2. However, the leader cables "L3" and "L4" can move to the side of the groove opening 23, namely outward in an axial direction, in the leader cable accommodating groove portion 2. When the leader cables "L3" and "L4" are left to move in such a manner, there is a fear for breaking up the coiled cables "L1" and "L2."

Further, after the leader cables "L3" and "L4" are accommodated in the leader cable accommodating groove portion 2 as illustrated in FIG. 14, a whole of the coil bobbin is molded together with the coils by using a resin in the conventional coil bobbin for a certain application. In such a coil bobbin, the leader cables "L3" and "L4" come off the leader cable accommodating groove portion 2 when placing the coil bobbin in a mold. Accordingly, there occurs failure molding.

In order to solve the problems described so far, the leader cables "L3" and "L4" are adhered onto the bottom plate portion 21 for a certain application. However, such an increase in the number of the manufacturing processes results in disadvantage in view of the strict cost reduction requirement imposed on the coil bobbin.

On the other hand, in the case of the other conventional leader cable accommodating groove portion 2 illustrated in FIG. 16, the leader cables "L3" and "L4" are held stably at the inlet portion of the leader cable accommodating groove portion 2. In the leader cable accommodating groove portion 2, the halves of the leader cables "L3" and "L4" on the side of the leader cable holding plate portion 3 are inhibited from coming off outward in an axial direction by the retainer plates 4, and the other halves of the leader cables "L3" and "L4" on the front end sides are inhibited from coming off outward in a radial direction by the side wall portion 22. As a result, the leader cables "L3" and "L4" holdability of the other leader cable accommodating groove portion 2 illustrated in FIG. 16 is improved with respect to the one illustrated in FIG. 13.

However, the operation of connecting the leader cables "L3" and "L4" with the coiled cables "L1" and "L2" with the coiled cables "L1" and "L2" is usually carried out on an outside of the leader cable accommodating groove portion 2 in a radial direction, for instance, the connecting operation is carried out as illustrated in FIG. 3. After completing the connecting operation, the front ends of the leader cables "L3" and "L4" should be bent inward in a radial direction and accommodated in the leader cable accommodating groove portion 2. Accordingly, the bent front ends of the leader cables "L3" and "L4" tend to bend back outward in a radial direction because of their elasticity. Since the side wall portion 22 should be disposed at portions of the leader cable accommodating groove portion 2 for accommodating the front ends of the leader cables "L3" and "L4" and since no retainer plate 4 cannot be disposed at the portions, the leader cables "L3" and "L4" are still liable to come off outward in an axial direction. Thus, the front ends of the leader cables "L3" and "L4" can hardly enjoy the effect of the provision of the retainer plates 4.

SUMMARY OF THE INVENTION

The present invention has been developed in view of the problems associating with the conventional coil bobbin. It is therefore an object of the present invention to provide a coil bobbin which can hold a front end of a leader cable stably in a leader cable accommodating groove portion thereof.

The above and other object of the present invention can be carried out by a coil bobbin which comprises:

a main cylinder portion opened at both ends thereof and made of a thin-walled resin around which a coil is wound; and a leader cable accommodating groove portion for accommodating a leader cable, the leader cable accommodating groove portion made of a thin-walled resin, disposed in a manner surrounding the main cylinder portion at one end of the main cylinder portion on an outer peripheral surface of the main cylinder portion, and including a bottom plate portion disposed in a manner projecting from the outer peripheral surface of the main cylinder portion outward in a radial direction, a side wall portion projecting from a front end of the bottom plate portion, disposed away from the main cylinder portion by a predetermined distance and extending in an axial direction, and a groove opening opened in an axial direction;

wherein the leader cable accommodating groove portion further includes a leader cable front end accomodating portion for accommodating a front end of the leader cable, the leader cable front end accommodating portion having a radialwise width, being smaller than a radialwise width of an inner portion of the leader cable accommodating groove portion, at a portion adjacent to the groove opening.

In a preferred embodiment of the coil bobbin according to the present invention, the leader cable front end accommodating portion of the leader cable accommodating groove portion has the radialwise width, being smaller than an outer diameter of an insulating resin member covering the leader cable to be accommodated in said leader cable accommodating groove portion, at the portion adjacent to the groove opening.

In another preferred embodiment of the coil bobbin according to the present invention, the leader cable front end accommodating portion of the leader cable accommodating groove portion further includes a presser projecting portion projecting inward in a radial direction at a front end of the side wall portion.

In a still another preferred embodiment of the coil bobbin according to the present invention, the main cylinder portion further includes a presser projecting portion projecting outward in a radial direction at a position corresponding to a front end of the side wall portion on an outer peripheral surface thereof, the presser projecting portion which is disposed at the leader cable front end accommodating portion of the leader cable accommodating groove portion.

In a further preferred embodiment of the coil bobbin according to the present invention, the side wall portion disposed at the leader cable front end accommodating portion of the leader cable accomodating groove portion is formed in a manner inclining inward in a radial direction.

In the coil bobbin according to the present invention, the leader cable accommodating groove portion includes the leader cable front end accommodating portion for accommodating the front end of the leader cable, and the leader cable front end accommodating portion has the radialwise width, being smaller than the radialwise width of inner portion of the leader cable accommodating groove portion (i.e., a radialwise width of an inner space of the leader cable accommodating groove portion disposed inward in a radial direction with respect to the portion adjacent to the groove opening), at the portion adjacent to the groove opening. Hence, the front end of the leader cable has been inhibited from coming off the inner portion of the leader cable accommodating groove portion and going over the groove opening outward in an axial direction.

As described above, the coil bobbin according to the present invention comprises the leader cable accommodating groove portion including the leader cable front end accommodating portion for accommodating the front end of the leader cable, and since the leader cable front end accommodating portion has the radialwise width, being smaller than the radialwise width of the inner portion of the leader cable accommodating groove portion (i.e., the radialwise width of an inner space of the leader cable accommodating groove portion disposed inward in a radial direction with respect to the portion adjacent to the groove opening), at the portion adjacent to the groove opening. As a result, the coil bobbin can effect the following advantages.

It is possible to inhibit the front end of the leader cable from coming off the inner portion of the leader cable accommodating groove portion and going over the groove opening outward in an axial direction. Since the side wall originally inhibits the front end of the leader cable from coming off outward in a radial direction at the leader cable front end accommodating portion of the leader cable accommodating groove portion for accommodating the front end of the leader cable, the coil bobbin according to the present invention can inhibit the front end of the leader cable from coming off the leader cable accommodating groove portion outward in a radial direction as well as outward in an axial direction. As a result, the coil bobbin can hold the front end of the leader cable in the leader cable accommodating groove portion stably to the highest degree. Therefore, it is possible to avoid the failure molding resulting from the front end of the leader cable, which comes off and projects from the leader cable accommodating groove portion, and accordingly occurring in the conventional coil bobbin.

Further, since the front end of the leader cable includes a connecting portion to which the coiled cable is connected and since the displacements of the connecting portion have been avoided securely, the coiled cable extending from the connecting portion can be inhibited from breaking up.

Furthermore, the manufacturing process of the coil bobbin according to the present invention can be simplified remarkably with respect to the manufacturing process of the conventional coil bobbin which includes a process of adhering the leader cable onto the bottom plate portion. In addition, in the coil bobbin according to the present invention, an operation of inserting a leader cable into the leader cable accommodating groove portion can be made easier with respect to the operation in the conventional coil bobbin illustrated in FIGS. 16, 17 and 18.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Figure 1:
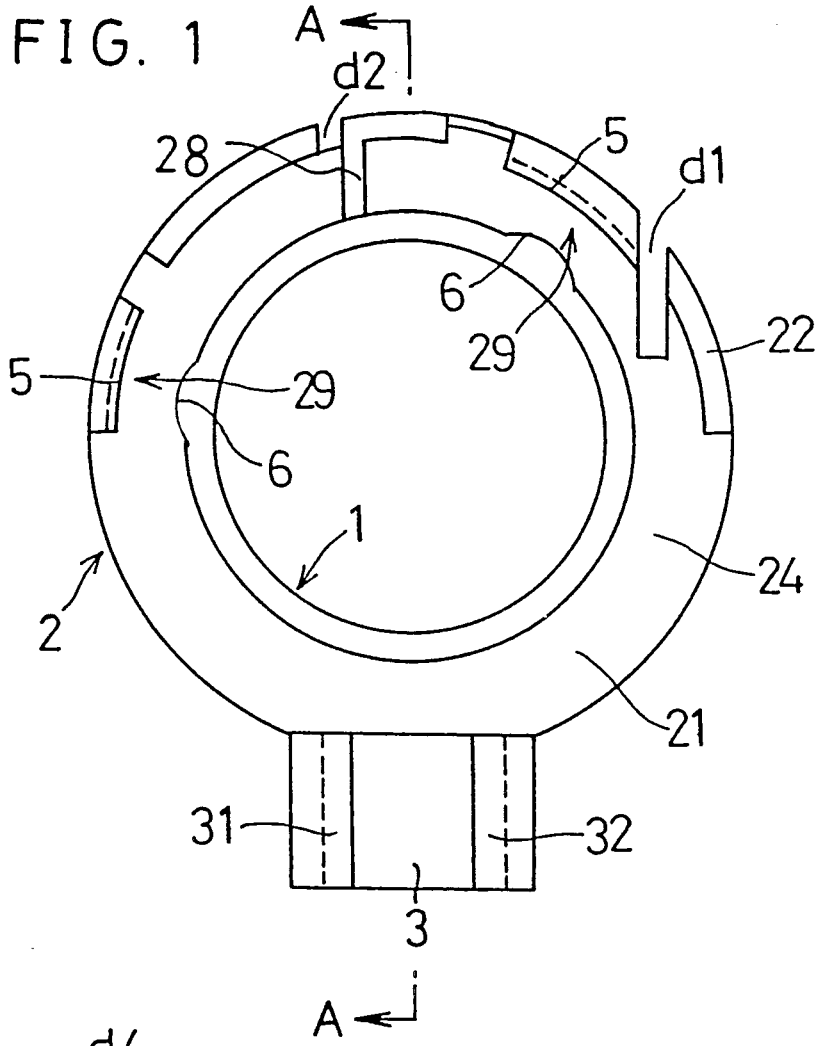
FIG. 1 is a front view of a First Preferred Embodiment of a coil bobbin according to the present invention.

Having generally described the present invention, a further understanding can be obtained by reference to the specific preferred embodiments which are provided herein for purposes of illustration only and are not intended to limit the scope of the appended claims.

FIRST PREFERRED EMBODIMENT

The First Preferred Embodiment of the coil bobbin according to the present invention will be hereinafter described with reference to FIGS. 1 through 6. Hereinafter, component parts having a similar function are designated at similar reference numerals in the present specification.

Figure 2:
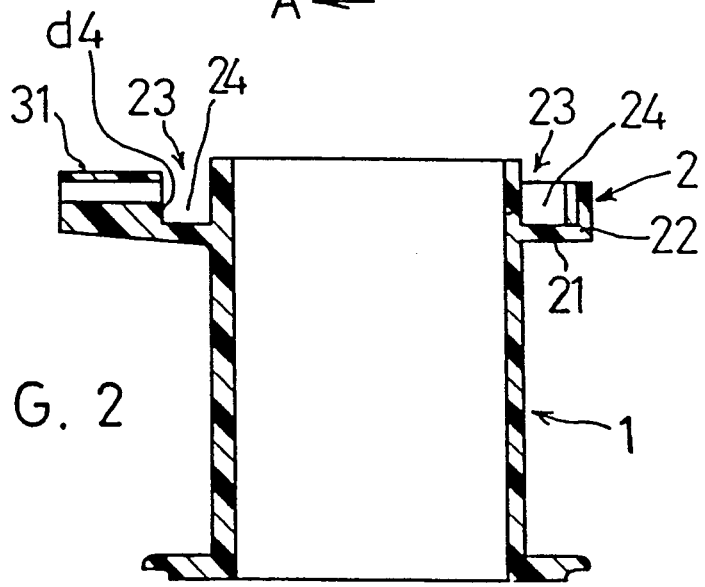
FIG. 2 is a cross sectional view of the First Preferred Embodiment taken in the arrows A—A of FIG. 1.

As illustrated in FIG. 2, this coil bobbin comprises a main cylinder portion 1 opened at both ends thereof and made of a thin-walled resin around which a coil is wound, and a leader cable accommodating groove portion 2 for accommodating leader cables "L3" and "L4." The leader cable accommodating groove portion 2 is made of a thin-walled resin, and disposed in a manner surrounding the main cylinder portion 1 at one end of the main cylinder portion 1 on an outer peripheral surface of the main cylinder portion 1. An outer peripheral configuration of the main cylinder portion 1 is formed in a simple cylinder. The outer peripheral configuration can be formed in the other various shapes, for instance, in a square cylinder or the like. The leader cable accommodating groove portion 2 has a shape which agrees with the outer periphery of the main cylinder portion 1. The main cylinder portion 1 and the leader cable accommodating groove portion 2 are made of nylon 6, 6 and molded with a mold by injection molding.

Further, the leader cable accommodating groove portion 2 includes a bottom plate portion 21 disposed in a manner projecting from the outer peripheral surface of the main cylinder portion 1 outward in a radial direction, a side wall portion 22 projecting from a front end of the bottom plate portion 21, disposed away from the main cylinder portion 1 by a predetermined distance and extending in an axial direction, and a groove opening 23 opened in an axial direction.

Figure 3:
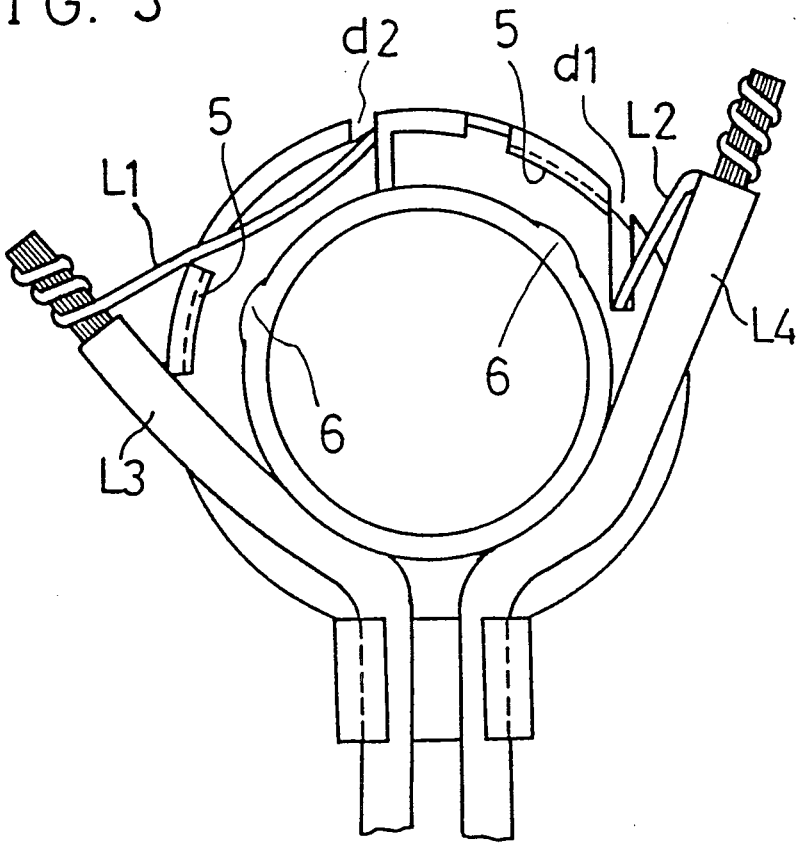
FIG. 3 is a front view of the First Preferred Embodiment illustrating how to connect coiled cables "L1" and "L2" to leader cables "L3" and "L4"
Figure 4:
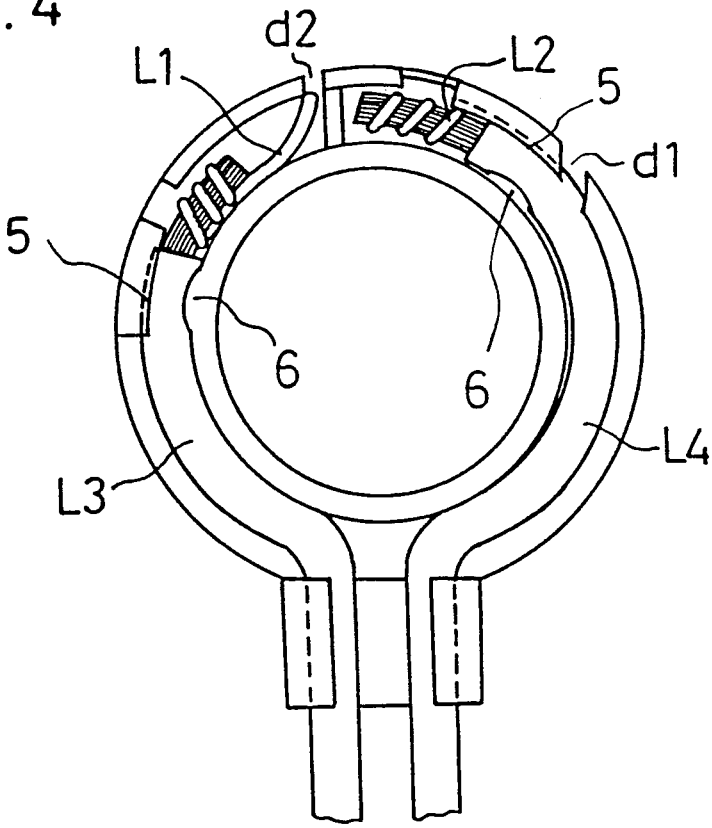
FIG. 4 is a front view of the First Preferred Embodiment illustrating how to accommodate the leader cables "L3" and "L4" in a leader cable accommodating groove portion 2.

The side wall portion 22 is provided at a front end portion which is disposed on an upper side of the bottom plate portion 21 in FIG. 1, and extended in an axial direction. No side wall portion 22 is provided at a front end portion which is disposed on a lower side of the bottom plate portion 21 in FIG. 1. As illustrated in FIGS. 3 and 4, take-out cut-offs "d1" and "d2" are disposed at predetermined positions of the side wall portion 22 in order to take out coiled cables "L1" and "L2." Further, as illustrated in FIG. 2, a take-in cut-off "d4" is disposed in an annular groove 24 in the leader cable accommodating groove portion 2 in order to take leader cables "L3" and "L4" in. Furthermore, at the position of the take-in cut-off "d4," a leader cable holding plate portion 3 is disposed in a manner projecting from an outer periphery of the bottom plate portion 21 outward in a radial direction. Moreover, on both sides of the leader cable holding the plate portion 3, presser covers 31 and 32 of a letter "L" shape substantially are disposed, thereby pressing and holding the leader cables "L3" and "L4." As illustrated in FIG. 3, the leader cables "L3" and "L4" are accommodated in the leader cable accommodating groove portion 2. In addition, as illustrated in FIG. 1, a partition plate 28 is disposed integrally with the side wall portion 22 on a side opposite to the leader cable holding plate portion 3 in a manner extending from an end of the side wall portion 22, which is adjacent to the take-out cut-off "d2," to the main cylinder portion 1. The partition plate 28 is provided in order to insulate the leader cables "L3" and "L4" each other.

Figure 5:
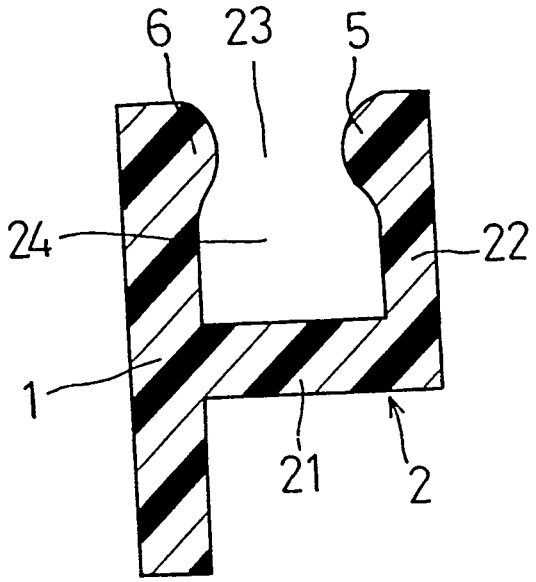
FIG. 5 is a partly enlarged cross sectional view of a leader cable front end accommodating portion 29 of the leader cable accommodating groove portion 2 of the First Preferred Embodiment which is viewed in a direction perpendicular to a radial direction.
Figure 6:
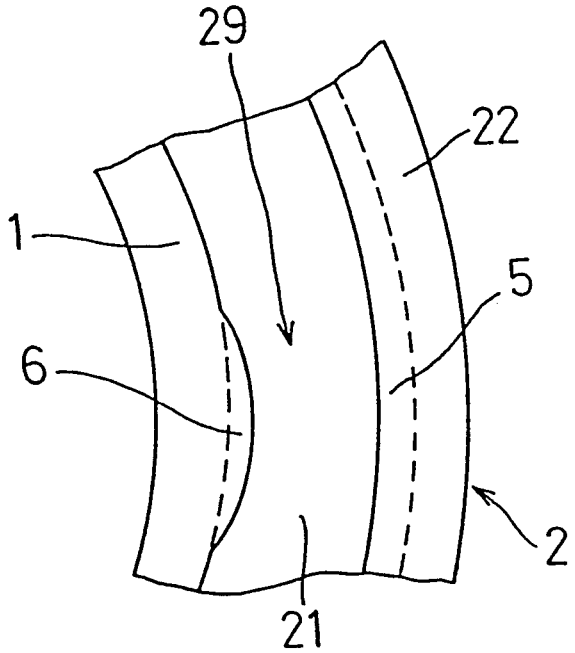
FIG. 6 is a partly enlarged front view of the leader cable front end accommodating portion 29 of the leader cable accommodating groove portion 2 of the First Preferred Embodiment.

Major features of the First Preferred Embodiment of the coil bobbin will be hereinafter described. At the leader cable front end accommodating portions 29 of the leader cable accommodating groove portion 2 for accommodating the leader cables "L3" and "L4," presser projecting portions 5 are disposed at front ends of the side wall portion 22 in a manner projecting inward in a radial direction. Also, at the leader cable front end accommodating portions 29, another presser projecting portions 6 are disposed at positions, facing the presser projecting portions 5, on the outer peripheral surface of the main cylinder portion 1 in a manner projecting outward in a radial direction. Thus, as illustrated in FIGS. 5 and 6, the presser projecting portions 5 and 6 narrow the leader cable front end accommodating portions 29 of the leader cable accommodating groove portion 2. Hence, the leader cable front end accommodating portions 29 come to have a radial width, which is smaller than an outer diameter of an insulating resin member covering the leader cables "L3" and "L4" to be accommodated therein, at portions adjacent to the groove opening 23.

A leader cable assembly process is carried out as follows, and the assembly process includes the insertion of the leader cables "L3" and "L4" into the leader cable accommodating groove portion 2. After inserting the leader cables "L3" and "L4" into the leader cable holding plate portion 3, the front ends of the leader cables "L3" and "L4" are extended outward in a radial direction of the leader cable accommodating groove portion 2. Similarly, the coiled cables "L1" and "L2" are taken in through the take-out grooves "d1" and "d2," extended outward in a radial direction of the leader cable accommodating groove portion 2, and thereafter their enamel covers are peeled off at the front ends thereof. Then, the coiled cables "L1" and "L2" are wound around the copper cable portions (i.e., the connecting portions) of the leader cables "L3" and "L4," and solder is built up at the connecting portions. Finally, the coiled cables "L1" and "L2" are taken out by way of the cut-off "d2" and "d1," respectively.

After completing the connection of the leader cables "L3" and "L4" to the coiled cables "L1" and "L2," the leader cables "L3" and "L4" are bent along the main cylinder portion 1 inward in a radial direction. Thereafter, the leader cables "L3" and "L4" are pressed inward in an axial direction, and inserted into the inside of the leader cable accommodating groove portion 2. At this moment, the presser projecting portions 5 are opened outward in a radial direction by the elasticity of the side wall portion 22, whereby the front ends of the leader cables "L3" and "L4" can be inserted into the leader cable accommodating groove portion 2 by way of the groove opening 23.

Figure 9:
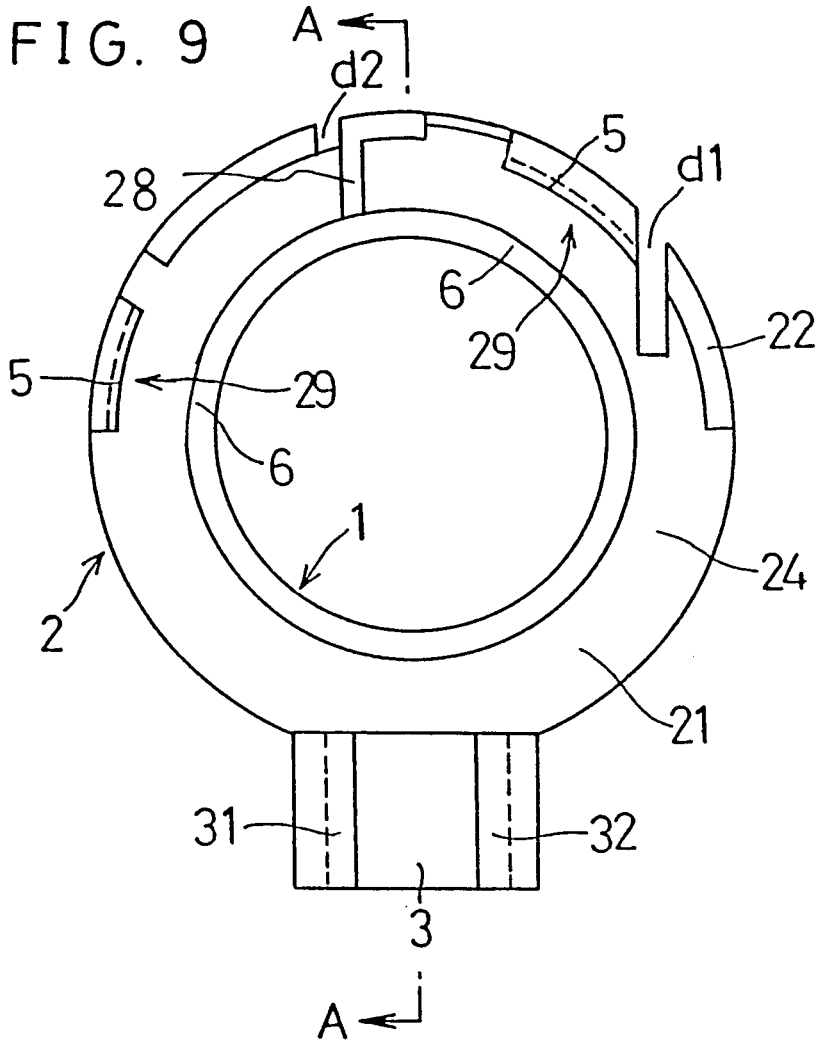
FIG. 9 is a front view of a modified version of the Preferred Embodiments of a coil bobbin according to the present invention.
Figure 10:
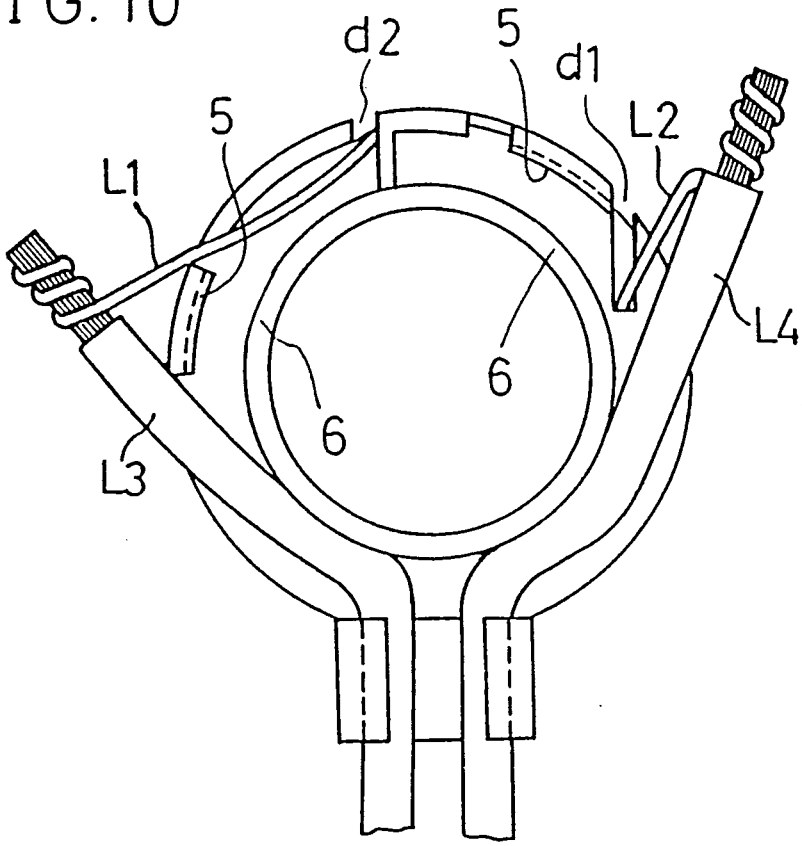
FIG. 10 is a front view of the modified version illustrating how to connect coiled cables "L1" and "L2" to leader cables "L3" and "L4"
Figure 11:
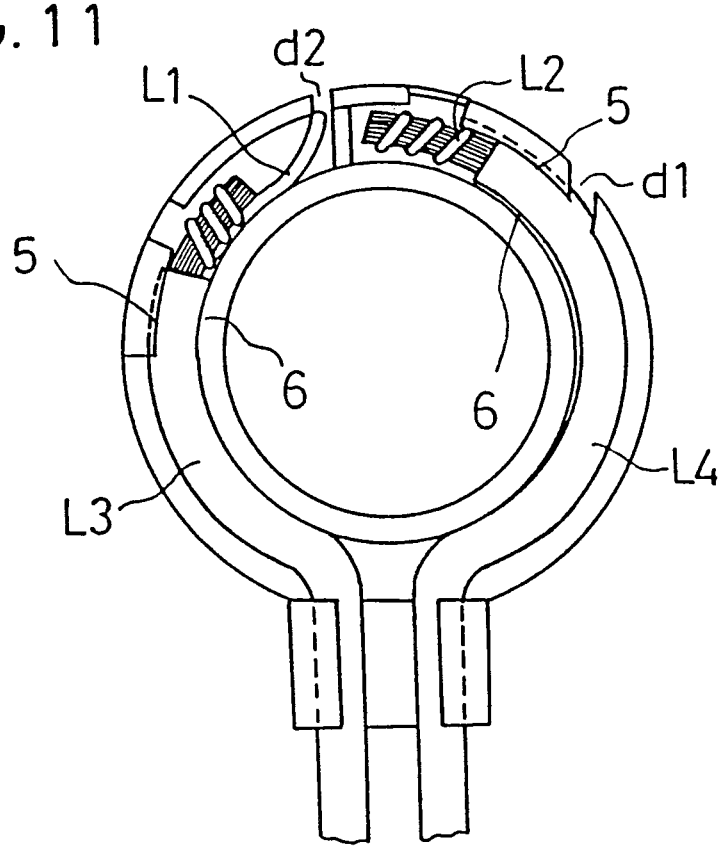
FIG. 11 is a front view of the modified version illustrating how to accommodate the leader cables "L3" and "L4" in a leader cable accommodating groove portion 2.
Figure 12:
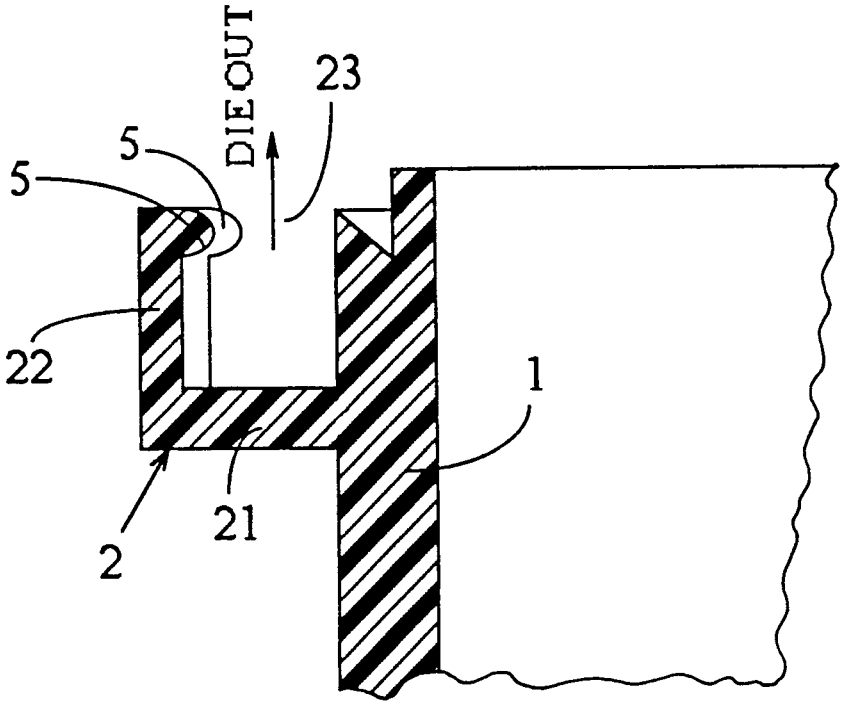
FIG. 12 is a partly enlarged cross sectional view of a leader cable front end accommodating portion 29 of the leader cable accommodating groove portion 2 of the modified version which is viewed in a direction perpendicular to a radial direction.
Figure 13:
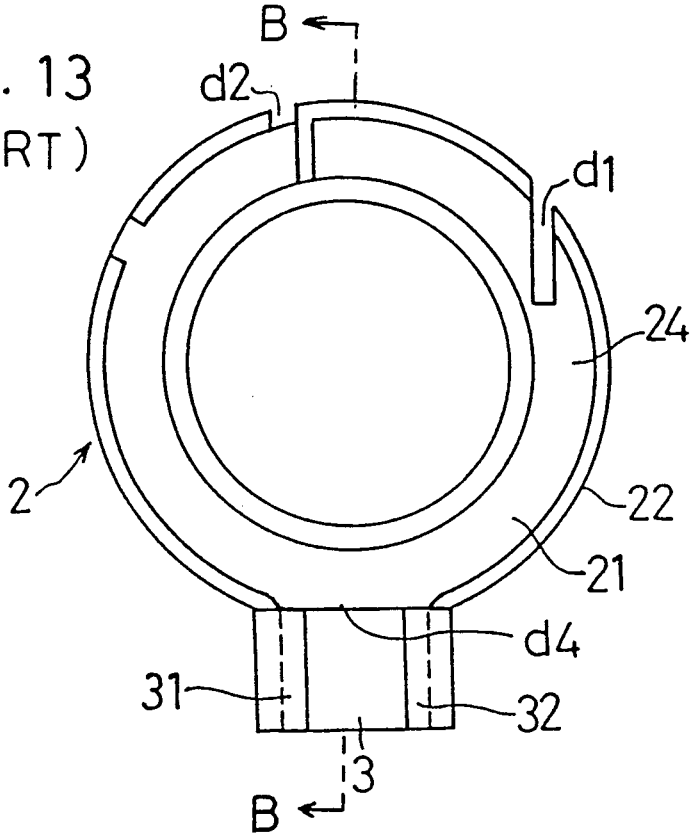
FIG. 13 (PRIOR ART)
FIG. 13 is a front view of a conventional coil bobbin.
Figure 14:
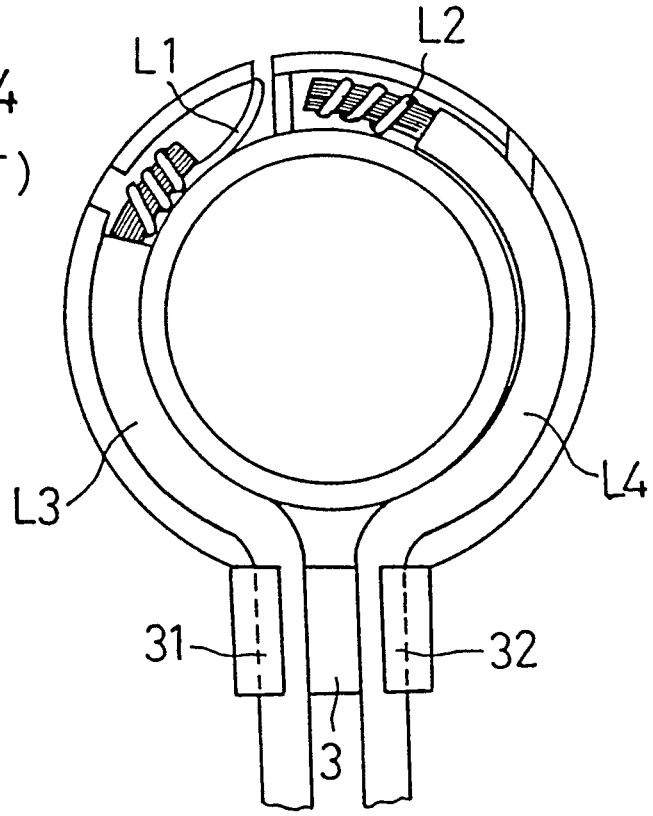
FIG. 14 (PRIOR ART)
FIG. 14 is a front view of the conventional coil bobbin illustrating how to accommodate leader cables "L3" and "L4" in a leader cable accommodating groove portion 2.
Figure 15:
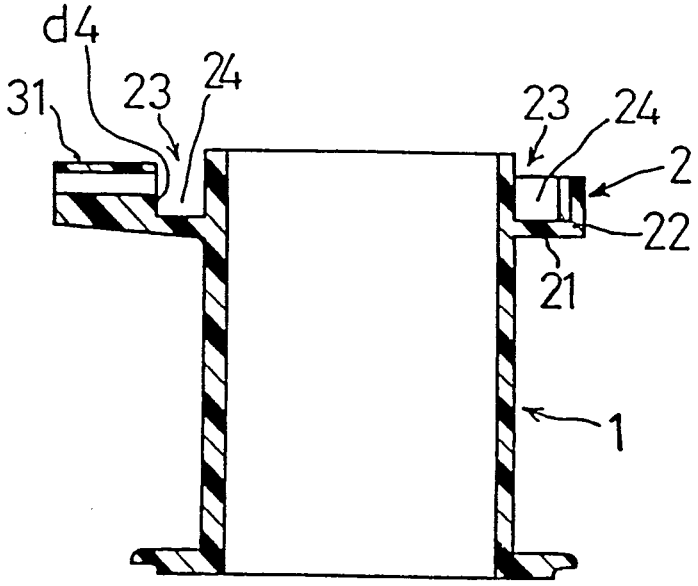
FIG. 15 (PRIOR ART)
FIG. 15 is a cross sectional view of the conventional coil bobbin taken in the arrows B—B of FIG. 13.
Figure 16:
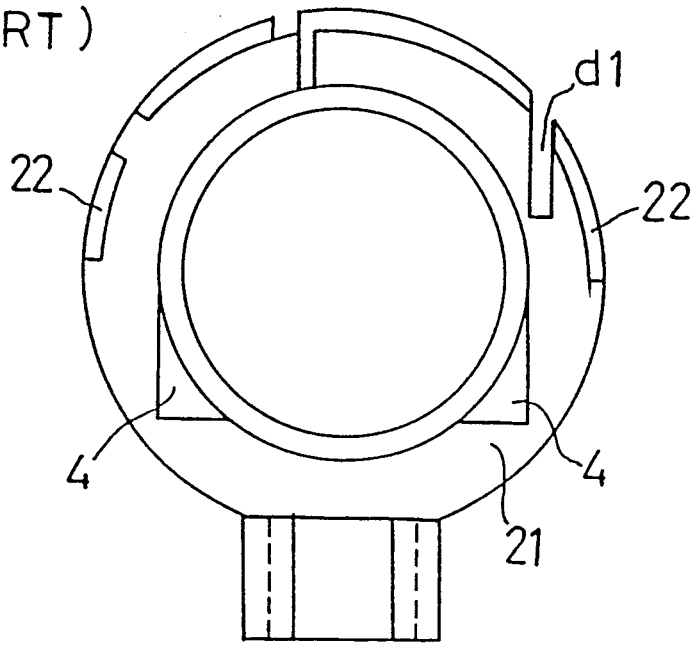
FIG. 16 (PRIOR ART)
FIG. 16 is a front view of another conventional coil bobbin.
Figure 17:
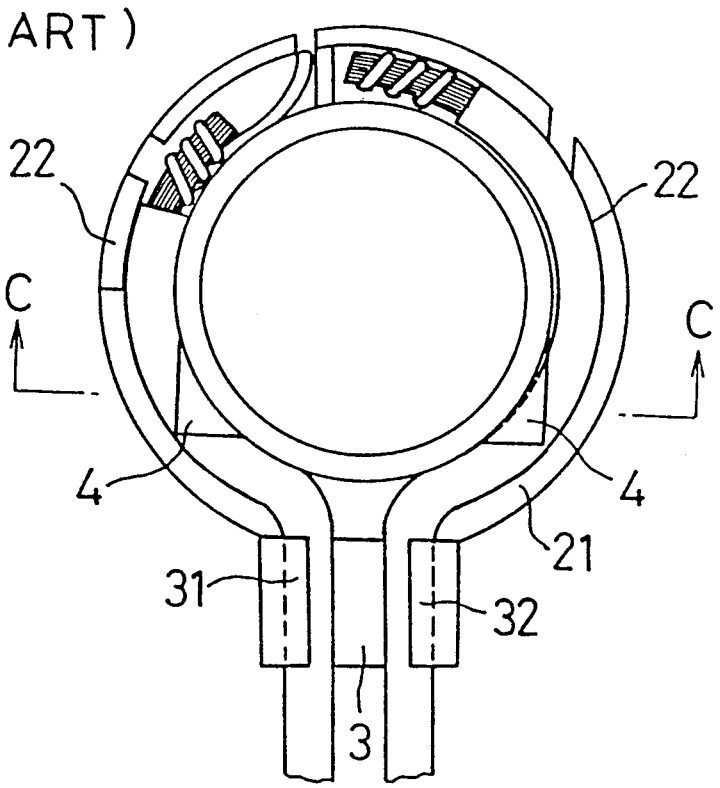
FIG. 17 (PRIOR ART)
FIG. 17 is a front view of the another conventional coil bobbin illustrating how to accommodate leader cables "L3" and "L4" in a leader cable accommodating groove portion 2.
Figure 18:
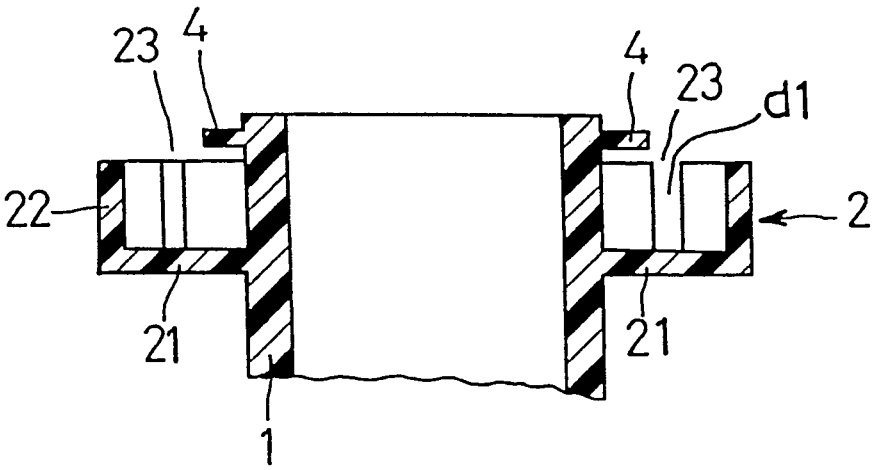
FIG. 18 (PRIOR ART)
FIG. 18 is a cross sectional view of the another conventional coil bobbin taken in the arrows C—C of FIG. 17.

In the First Preferred Embodiment of the coil bobbin according to the present invention described so far, the leader cables "L3" and "L4" are held stably by the leader cable holding plate portion 3 and the leader cable front end accommodating portions 29. Accordingly, a half of the side wall portion 22 has been got rid of on a lower side of the bottom plate portion 21 as illustrated in FIG. 1. On the other hand, in one of the conventional coil bobbins illustrated in FIGS. 9, 10 and 11, the side wall portion 22 is disposed in a manner going round on the bottom plate portion 21 and the front ends of the side portion 22 are connected to the leader cable holding plate portion 3. Hence, the manufacturing cost of the First Preferred Embodiment of the coil bobbin has been reduced to a remarkable extent.

SECOND PREFERRED EMBODIMENT

Figure 7:
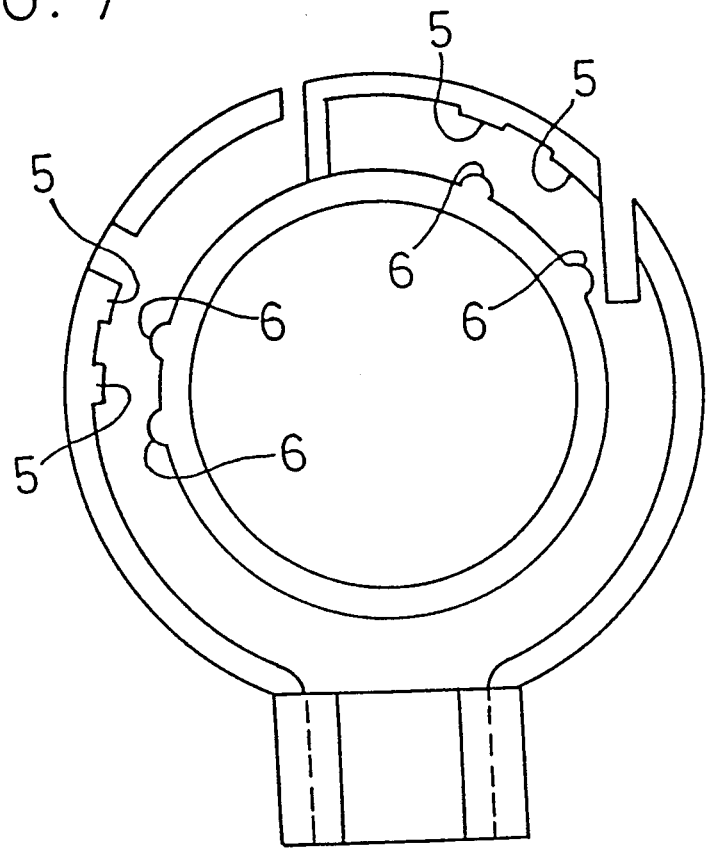
FIG. 7 is a front view of a Second Preferred Embodiment of a coil bobbin according to the present invention.

The Second Preferred Embodiment of the coil bobbin according to the present invention will be hereinafter described with reference to FIG. 7. In this Second Preferred Embodiment, the presser projecting portions 5 and 6 described in the First Preferred Embodiment are disposed alternately in series in a circumferential direction of a side wall portion 22 and a main cylinder portion 1. With this arrangement, the holdability of the leader cables "L3" and "L4" can be improved further in a leader cable accommodating groove portion 2.

THIRD PREFERRED EMBODIMENT

Figure 8:
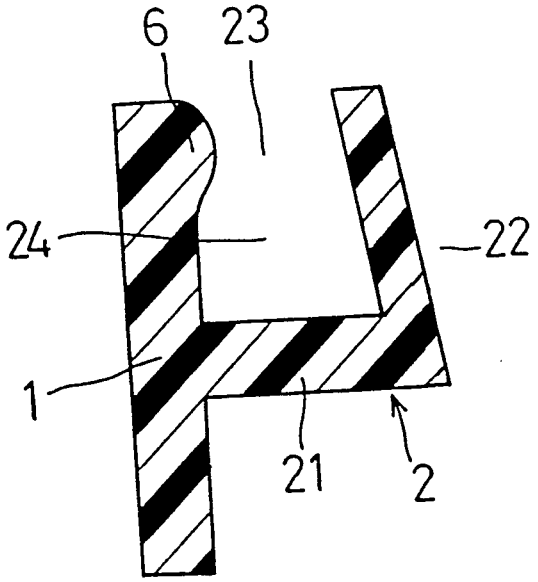
FIG. 8 is a partly enlarged cross sectional view of a leader cable front end accommodating portion 29 of a leader cable accommodating groove portion 2 of a Third Preferred Embodiment of a coil bobbin according to the present invention which is viewed in a direction perpendicular to a radial direction.

The Third Preferred Embodiment of the coil bobbin according to the present invention will be hereinafter described with reference to FIG. 8. In this Third Preferred Embodiment, at leader cable front end accommodating portions 29 of a leader cable accommodating groove portion 2, a side wall portion 22 is disposed in a manner inclining inward in a radial direction from a bottom plate portion 21 to the front end thereof, instead of the presser projecting portions 5 disposed at the front ends on the inner peripheral surface of the side wall portion 22 of the First Preferred Embodiment.

Hence, the side wall portion 22 of this Third Preferred Embodiment is deformed outward in a radial direction when inserting the leader cables "L3" and "L4." After the insertion, the side wall portion 22 is retracted inward in a radial direction, thereby narrowing a groove opening 23. Thus, this Third Preferred Embodiment has effected advantages similar to those of the First Preferred Embodiment.

In addition, a modified version of the above described First through Third Preferred Embodiments will be described below with reference to FIGS. 9, 10, 11 and 12. As clearly illustrated in FIG. 12 (i.e., a partly enlarged cross sectional view of FIGS. 9, 10 and 11), the modified version of the coil bobbin is provided with a plurality of presser projecting portions 5 at a top end on an inner wall surface of a side wall portion 22. No presser projecting portions 6 are disposed on an outer peripheral surface of a main cylinder portion 1. This arrangement makes it easier to draw out a coil bobbin molding die. Namely, when drawing out the die, the presser projecting portions 5 of the modified version are more likely to move outward in a radial direction. On the other hand, the presser projecting 5 of the First Preferred Embodiment or the like are less likely to move inward in a radial direction.

Having now fully described the present invention, it will be apparent to one of ordinary skill in the art that many changes and modifications can be made thereto without departing from the spirit or scope of the present invention as set forth herein including the appended claims.

What is claimed is:

1. A coil bobbin comprising:

a main cylinder portion opened at both ends thereof and made of a thin-walled resin around which a coil is wound; and a leader cable accommodating groove portion for accommodating a leader cable, said leader cable accommodating groove portion made of a thin-walled resin, disposed in a manner surrounding said main cylinder portion at one end of said main cylinder portion on an outer peripheral surface of said main cylinder portion, and including a bottom plate portion disposed in a manner projecting from said outer peripheral surface of said main cylinder portion outward in a radial direction, a side wall portion projecting from a front end of said bottom plate portion, disposed away from said main cylinder portion by a predetermined distance and extending in an axial direction, and a groove opening opened in an axial direction;

wherein said leader cable accommodating groove portion further includes a leader cable front end accommodating portion for accommodating a front end of said leader cable, said leader cable front end accommodating portion having a radialwise width, being smaller than a radialwise width of an inner portion of said leader cable accommodating groove portion, at a portion adjacent to said groove opening.

2. The coil bobbin according to claim 1, wherein said leader cable front end accommodating portion of said leader cable accommodating groove portion has said radialwise width, being smaller than an outer diameter of an insulating resin member covering said leader cable to be accommodated in said leader cable accommodating groove portion, at said portion adjacent to said groove opening.

3. The coil bobbin according to claim 1, wherein said leader cable front end accommodating portion of said leader cable accommodating groove portion further includes a presser projecting portion projecting inward in a radial direction at a front end of said side wall portion.

4. The coil bobbin according to claim 1, wherein said main cylinder portion further includes a presser projecting portion projecting outward in a radial direction at a position corresponding to a front end of said side wall portion on an outer peripheral surface thereof, said presser projecting portion disposed at said leader cable front end accommodating portion of said leader cable accommodating groove portion.

5. The coil bobbin according to claim 1, wherein said side wall portion disposed at said leader cable front end accommodating portion of said leader cable accommodating groove portion is formed in a manner inclining inward in a radial direction.

* * * * *

UNITED STATES PATENT AND TRADEMARK OFFICE

CERTIFICATE OF CORRECTION

PATENT NO. : 5,058,821

DATED : 10/22/91

INVENTOR(S) : TAKEHIKO YAMASHITA

It is certified that error appears in the above-identified patent and that said Letters Patent is hereby corrected as shown below:

Column 1, line 32, please insert --a-- before "manner".

Column 2, line 41, please delete "13" and insert --L3--.

Column 3, line 17, please delete "with the coiled cables "L1" and "L2".

Column 5, line 49, please start a new paragraph after "L3 and L4".

Signed and Sealed this

Twenty-seventh Day of April, 1993

*Attest:*

MICHAEL K. KIRK

*Attesting Officer*

*Acting Commissioner of Patents and Trademarks*